US005137472A

United States Patent [19]

Hillbish et al.

[11] Patent Number: 5,137,472

[45] Date of Patent: Aug. 11, 1992

[54] MEANS FOR SECURING GROUND PLATES TO ELECTRICAL CONNECTOR HOUSING

[75] Inventors: Warren C. Hillbish, Hummelstown; John W. Kaufman, Hershey; Brian J. Vogl, Lemoyne, all of Pa.

[73] Assignee: AMP Incorporated, Harrisburg, Pa.

[21] Appl. No.: 786,696

[22] Filed: Nov. 1, 1991

[51] Int. Cl.[5] ..... H01R 13/648

[52] U.S. Cl. ..... 439/607; 439/108; 439/741

[58] Field of Search ..... 439/92, 101, 108, 607, 439/608, 609, 610, 741, 870; 29/876, 882, 842, 844

[56] References Cited

U.S. PATENT DOCUMENTS

| | | | |
|---|---|---|---|
| 4,655,518 | 4/1987 | Johnson et al. . | |
| 4,846,727 | 7/1989 | Glover et al. | 439/108 X |
| 4,867,690 | 9/1989 | Thumma | 439/79 |
| 4,869,677 | 9/1989 | Johnson et al. | 439/80 |
| 4,878,858 | 11/1989 | Dechelette | 439/108 X |
| 4,880,388 | 11/1989 | Beamenderfer | 439/108 |
| 4,950,172 | 8/1990 | Annault et al. | 439/108 |
| 4,959,024 | 9/1990 | Czeschka | 439/607 |
| 5,035,631 | 7/1991 | Piorunneck et al. | 439/108 |
| 5,035,632 | 7/1991 | Rudoy et al. | 439/108 |

*Primary Examiner*—Neil Abrams
*Assistant Examiner*—Khiem Nguyen
*Attorney, Agent, or Firm*—Katherine A. Nelson

[57] ABSTRACT

Improved means for securing an externally mounted ground plate to an electrical connector, the ground plate being secured along one of the sides of the connector and having a leading edge thereof exposed at the mating face of the connector and adapted to be received within the housing of a complementary connector upon the connector being mated thereto. The improved means includes a pair of tabs extending from the ground plate proximate the leading edge thereof and engagable with and latchingly securable in cooperating slots on end walls of the connector housing and a plurality of ground plate flared apertures lockingly secured within corresponding slots of the connector sidewalls proximate the leading edges thereof. The secured ground plate lies against the side wall and the overall dimensions of the mating face are not substantially increased thereby.

4 Claims, 8 Drawing Sheets

MEANS FOR SECURING GROUND PLATES TO ELECTRICAL CONNECTOR HOUSING

FIELD OF THE INVENTION

This invention relates to an electrical connector assembly and more particularly to connector assemblies having externally mounted ground or shield plates.

BACKGROUND OF THE INVENTION

Most electronic equipment uses a plurality of board-to-board connectors to interconnect circuitry plurality of daughter boards to a mother board or back plane. The circuit boards may be mounted in a vertical or horizontal relationship depending upon the configuration of the mating connector members. The demand for connectors that solve problems such a mode noise, ground inductance, and cross talk has increased with the density and speed of the electronic circuity. It is desirable, therefore, that high density electrical connectors include means to provide low inductance and low resistance ground connection from the connector to the circuit board to which it is attached. It is further desirable that the ground connection be of a type that mates first and breaks last.

U.S. Pat. No. 5,035,631 discloses a grounding shield for a card edge connector. The ground shield is secured to the connector housing by a plurality of fingers that engage apertures along the mating face of the connector.

U.S. Pat. Nos. 4,655,518 and 4,869,677 disclose a two-piece connector assembly that provides grounding contacts within the dielectric walls of the pin header and includes a plurality of ground plates secured by a plurality of tabs to the exterior wall adjacent the mating face of the receptacle member.

U.S. patent application Ser. No. 07/767,344 discloses an electrical connector assembly having a plurality of ground pins in a pin header and ground plates mounted along the exterior walls of the mating receptacle member.

When mounting plates along the exterior walls, particularly along the mating face, it is important that the ground plate lie against the dielectric housing material along the full length to assure proper mating of the connectors without stubbing the contacts in the mating connectors. The problem of separation between the ground plate and housing wall is exacerbated if the dielectric member is at all bowed and tends to separate even slightly from the outer metal wall. It is desirable therefore to provide a means to secure these two layers approximate the mating face such that the overall dimension of the mating face of the connector is not increased. Furthermore, it is desirable that the means for securing be one that minimizes the need for extra parts, one that dies not greatly increase the assembly steps and furthermore be one that is cost effective.

SUMMARY OF THE INVENTION

Accordingly, the present invention is directed to an electrical connector having externally mounted ground plates that eliminates the problems and disadvantages of the prior art. For purposes of illustrating the invention, the ground plates are being shown attached to the elongate sides of a connector known as a "pin header".

The present invention is directed to an improved means for securing an externally mounted ground plate to an electrical connector. The connector includes a housing having opposed elongate sides and opposed ends which together define a mating face. The connector housing further includes a plurality of elongated slots extending a selected distance rearwardly in from the leading edge of the elongate walls The housing slots are adapted to cooperate with corresponding inwardly directed extrusion portions of the ground plate, as more fully explained below. A plurality of electrical terminals are disposed within the housing and are exposed at the mating face for electrical connection to corresponding terminals of a mating connector. The connector includes at least one ground plate secured along one of the elongate sides and having a leading edge thereof member exposed at the mating face. The leading edge of the ground plate being adapted to be received within the complimentary connector housing. The improved means for securing the ground plate to the connector includes a pair of tabs extending from side edges thereof proximate the leading edge and engagable with cooperating slots on the end walls of the housing member. The tabs include outwardly extending locking lances that cooperate with locking means within the slots to securely hold the ground plate to the housing walls. The ground plate further includes inwardly directed extrusions proximate the leading edge thereof and spaced along the length of the plate. The inwardly directed extrusions are received in cooperating slots of the housing and secured thereto by expanding the leading edge of the extrusions outwardly by means of an appropriately shaped tool. The leading edge of the ground plate is thereby secured at selected locations to the housing side wall thereby preventing separation of the ground plate and side wall along the mating face. When the ground plate is secured to the housing, the pair of locking tabs hold the plate securely at the end walls and the extrusions hold the plate securely to the forward end of the mating face.

In the preferred embodiment the plate member is also provided with a plurality of inwardly directed stop portions rearwardly of the leading edge, which locate and align the leading edge of the plate with respect to the forward edge of the associated elongate housing wall.

It is an object of the invention to provide an improved means for securing a ground plate to an external surface of an electrical connector.

It is an additional object to provide a connector having a ground plate mounted externally thereto that minimizes stubbing at the mating face when the mating face is received in a complimentary connector housing.

It is another object of the invention to provide a means for securing a ground plate to an external housing wall in a manner to minimize interruption of the electrical paths.

It is a further object of the invention to provide a means for securing a ground plate to a connector in a manner that does not increase the overall dimensions of the mating face of the connector.

It is yet another object of the invention to provide a means for securing a ground plate to a housing wall in a manner that minimizes separation of the ground plate and the associated wall at the mating face of the connector.

Another object of the invention is to provide a means for securing a ground plate to a connector to ensure that the ground shield mates first and breaks last.

An embodiment of the present invention will now be described by way of example with reference to the accompanying drawings.

DETAILED DESCRIPTION OF THE DRAWING

Figure 1:
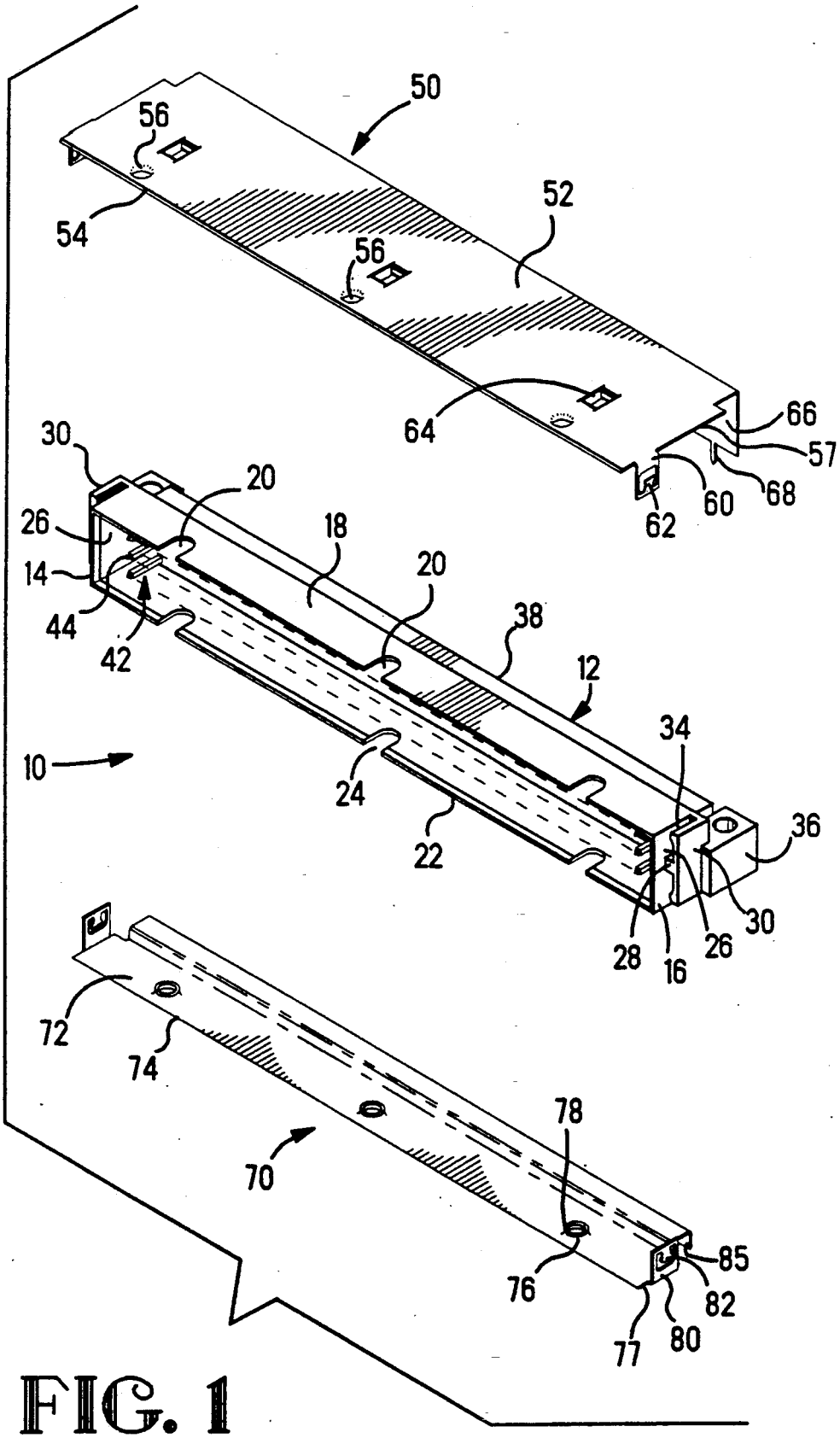
FIG. 1 is an exploded perspective view of a connector having upper and lower ground plates secured externally to the housing thereof
Figure 3:
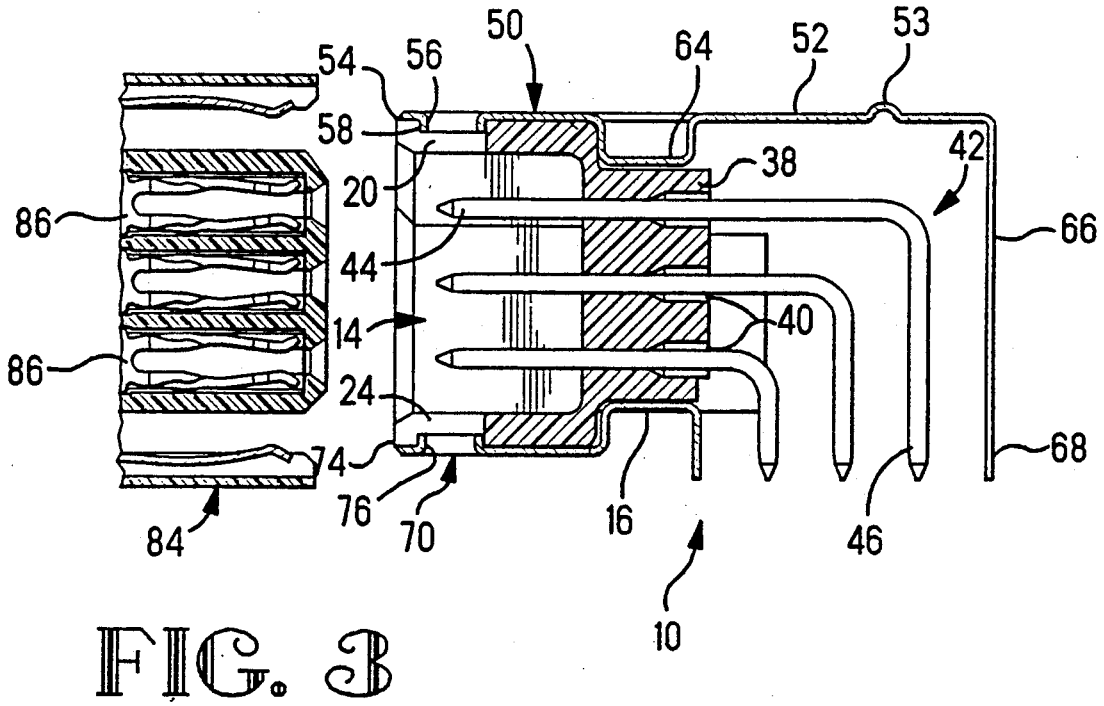
FIG. 3 is a cross sectional view of the assembled connector being mated with a fragmentary portion of the complimentary connector.
Figure 4:
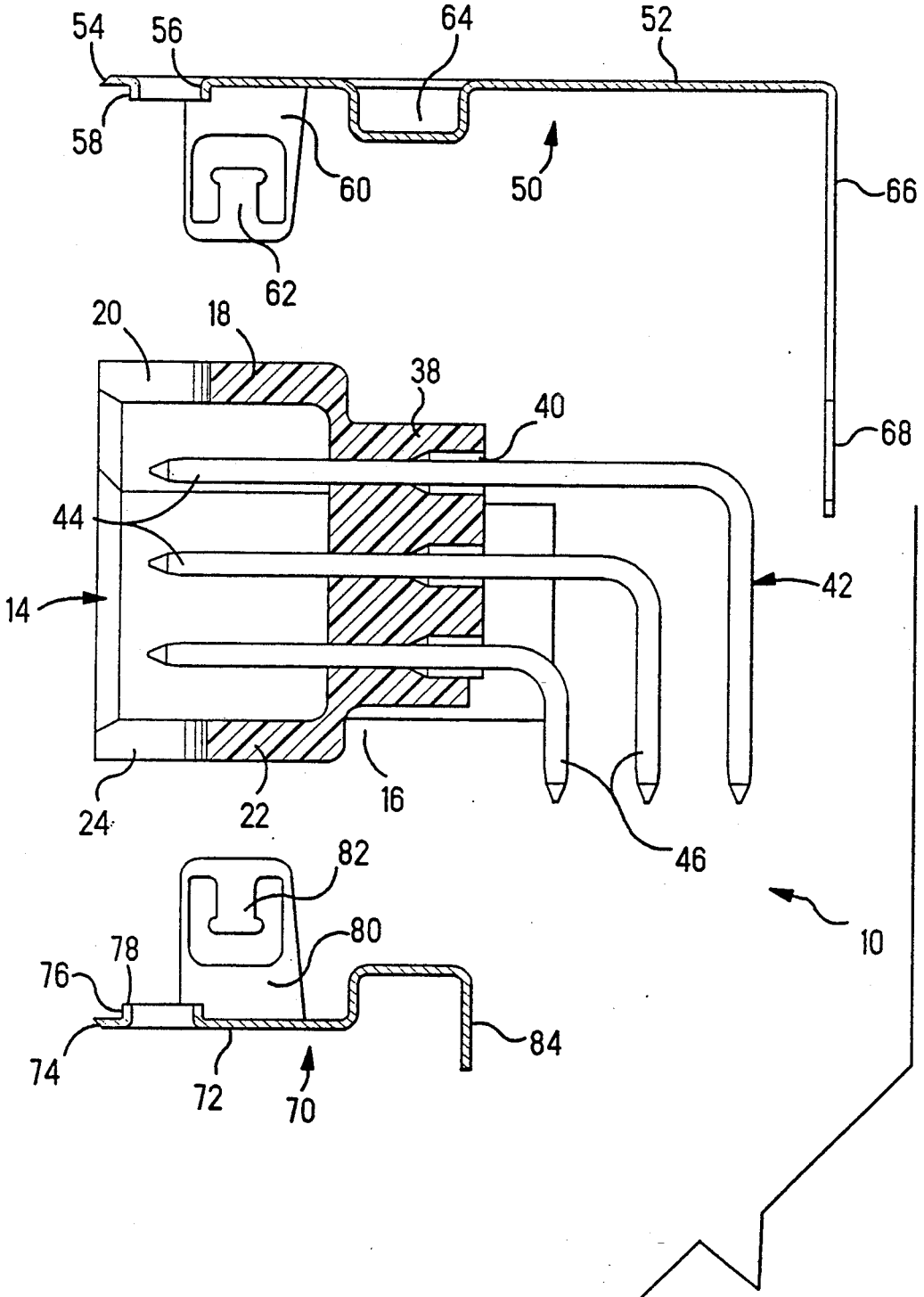
FIG. 4 is an exploded cross sectional view of the connector of the present invention.

FIG. 1 shows an exploded view of a pin header connector 10 made in accordance with the invention. Connector 10 includes a housing 12 and upper and lower ground plates 50,70 respectively. Housing 12 includes a mating face 14, mounting face 16 and opposed upper and lower elongate side walls 18,22, opposed end walls 26 and rear wall 38. The opposed elongate side walls 18,22 and opposed end walls 26 define the mating face 14. As is best seen in FIGS. 1, 3 and 4 the upper and lower side walls 18 and 22 include a plurality of inwardly directed slots 20,24 having a selected length. The slots are adapted to cooperate with extruded projections of the respective ground plate members 50,70 to secure the ground plate to the respective side wall at the selected locations. A plurality of electrical terminal members 42 are disposed within respective terminal receiving passageways 40 and include first and second connecting portions 44,46 as best seen in FIG. 3. Referring now to FIGS. 1 and 3, first terminal connecting portions 44 are exposed at the mounting face for electrical connection to corresponding terminal members 86 of a mating connector 84.

Figure 5:
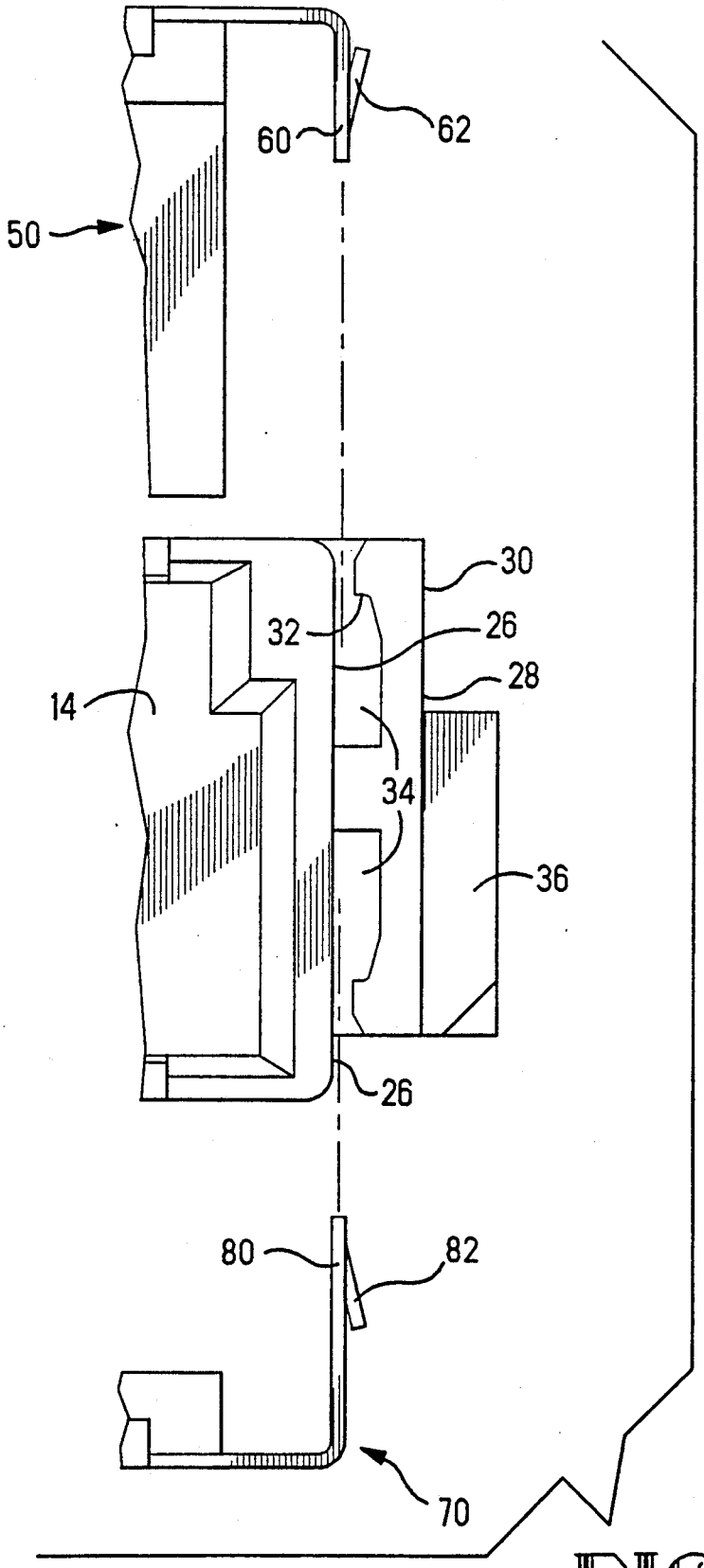
FIGS. 5 and 6 illustrate the locking engagement between the ground plate members and the connector end walls.
Figure 6:
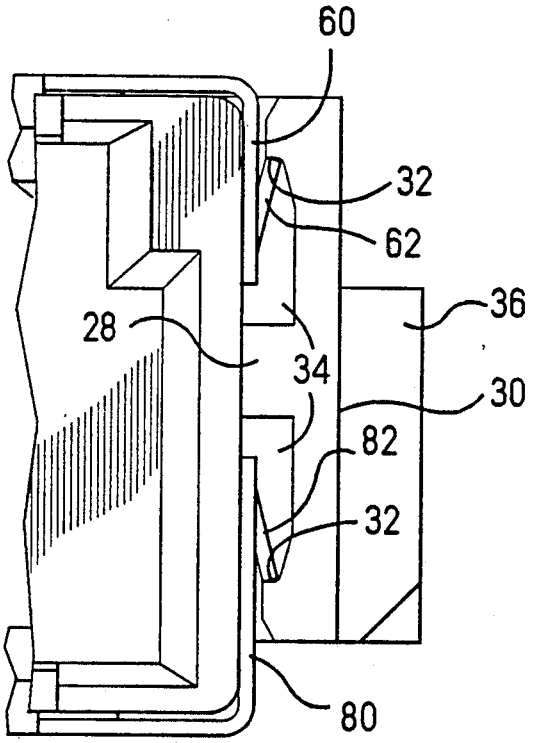

Housing end walls 26 further include outwardly extending first and second flange portions 28,36. First flange portion 28 extends outwardly from the end wall and includes oppositely directed wall portions 30 spaced from wall 26 and defining ground tab receiving cavities therebetween, as best seen in FIGS. 5 and 6. The inner wall portion of 30 further includes a stop ledge 32 at the end thereof for lockingly engaging the ground plate tabs as described more fully below.

Figure 2:
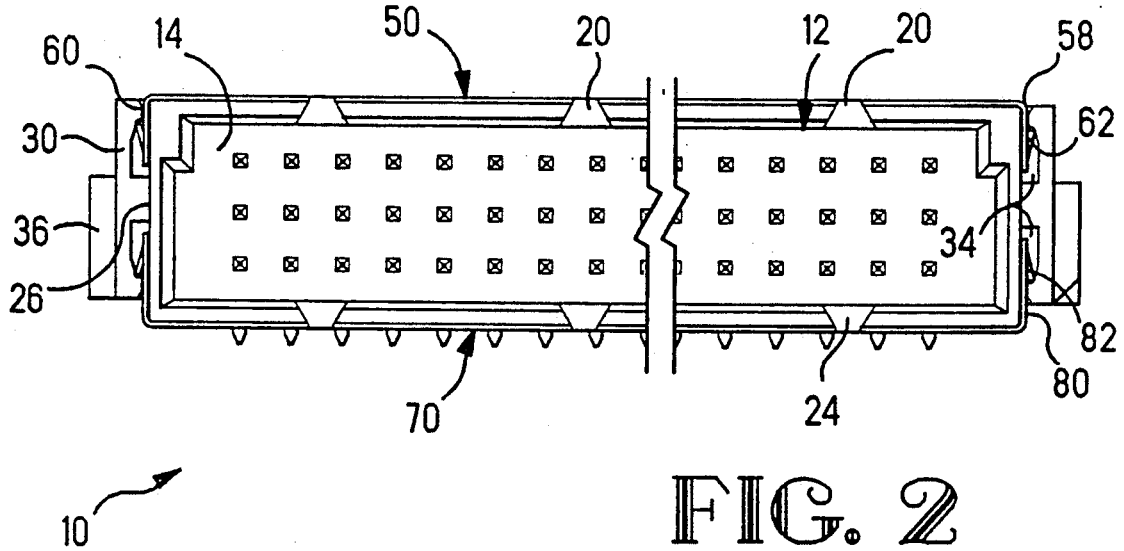
FIG. 2 is a flat plane view of the assembled connector.

Referring now to FIGS. 1, 2 and 3, the upper ground plate 50 includes a top or plate portion 52 having a forward or leading edge 54 that extends to the mating face 14 of connector housing 12 and opposed side edges 57. The leading ground plate edge 54 includes a plurality of extruded portions 56 extending downwardly at selected locations, the extruded portions 56 being adapted to be received within the corresponding slots 20 of the upper housing wall 18 and to be secured thereto by means of a tool such as tool 90 shown in FIGS. 7 through 9. Upper ground plate 50 further includes a pair of tabs 60 extending from the side 57 thereof and proximate the leading edge 54. Tabs 60 include outwardly directed locking lances 62 which cooperate with locking surfaces 32 within the tab receiving slots 34 proximate end wall 26 as best seen in FIGS. 5 and 6. Tabs 60 are preferably located as close to the mating face as possible to minimize the problem of separation of the housing side wall and plate member 50.

As best seen in FIGS. 1 and 3 ground plate 50 further includes a rear wall 66 having a plurality of terminal portions 68 for engaging the ground conductors within a circuit board (not shown) when connector 10 is mounted thereto. It is to be understood that the ground plate construction disclosed herein is not limited to right angle pin header connectors only. The connector shown herein is merely representative of various connectors with which the ground plate may be used. U.S. patent application Ser. No. 07/786,644, filed concomitantly herewith, discloses a "toolless" method for securing a ground plate to a connector housing.

Referring again to FIGS. 1 and 3, lower ground plate 70 includes a plate portion 72 having a leading edge 74 and opposed side edges 77. The leading ground plate edge 74 includes a plurality of extruded portions 76 extending downwardly at selected locations, the extruded portions 76 being adapted to be received within the corresponding slots 24 of the upper housing wall 22 and to be secured thereto by means of a tool such as tool 90 shown in FIGS. 7 through 9. Lower ground plate 70 also includes tabs 80 extending from the side 77 of plate 72 proximate the leading edge 74 thereof. Tabs 80 include locking lances 82 which are secured in the corresponding lower tab receiving cavity 34 of housing 12 in the same manner as previously described and as best seen in FIGS. 5 and 6. As shown in FIG. 3 the lower ground plate 70 includes terminal members 85 extending downwardly therefrom for being received in a ground plane of the circuit board.

In the preferred embodiment ground plate 50, further includes at least one locating or positioning stop 64 formed in the plate portion 52 rearwardly of the connector mating face 14 to keep the respective leading edge 54 of the ground plate 50 aligned with the housing walls 18 at the mating face 14. Ground plate 70 may also be provided with similar stop means. Alternatively, the positioning means may comprise an elongate groove extending along the entire width of the ground plate, or the ground plate may be shaped to conform to the actual shape of the housings.

In assembling the connector of the present invention, the terminal members 42 are inserted into the housing prior to attaching the ground plates 50, 70. The ground plates are then positioned so that the stop means abut the shoulder of the housing 12 and the respective leading edges 54,74 are received in the associated wall recesses 20, 24. The ground plate tabs 58, 78 are inserted into the tab receiving cavities 34 and are locked within the cavities by lances 60, 80 engaging corresponding locking ledges 32.

The ground plates 50,70 are preferably stamped from a formable, electively conductive metal, such as copper alloys, or the like. Suitable dielectric materials for the connector housing include glass filled polyesters and other similar materials, as known in the art.

Figure 7:
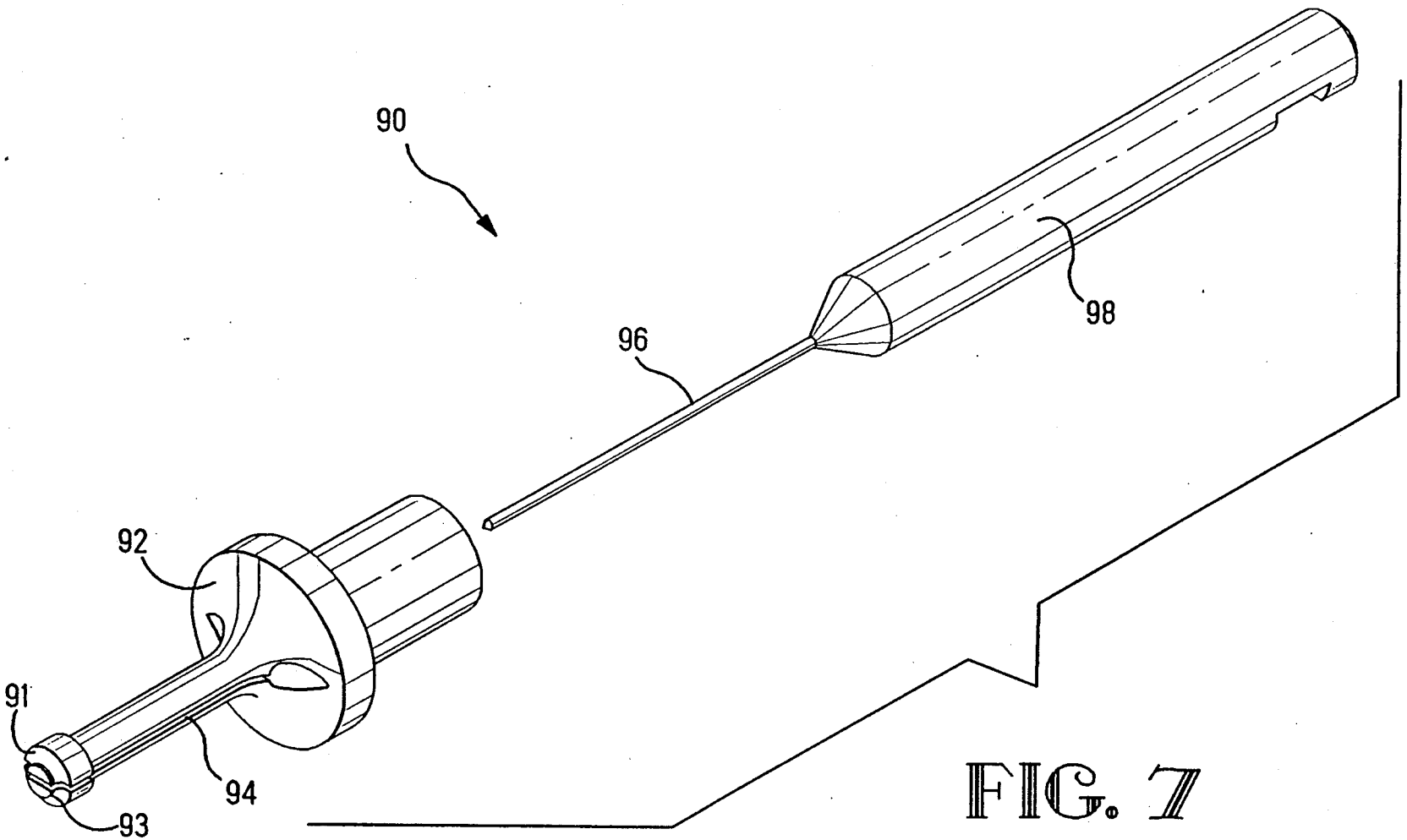
FIG. 7 is a perspective view of a tool used to secure the plate of the present invention to the connector.
Figure 8:
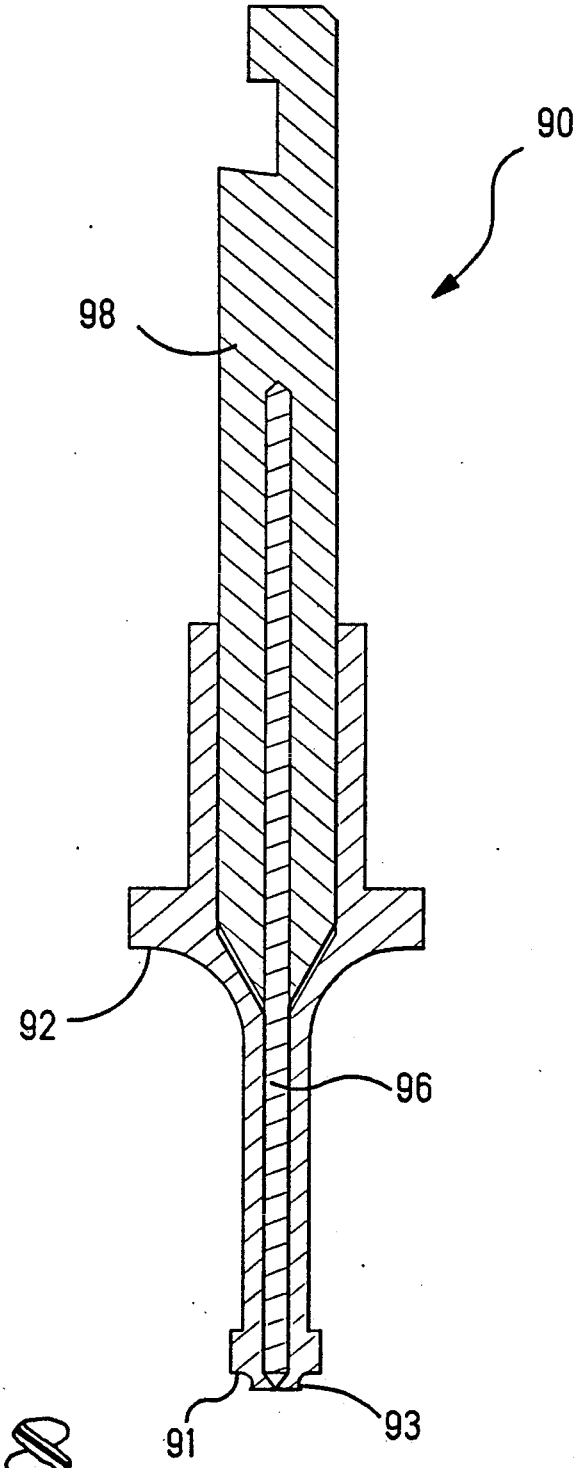
FIGS. 8 and 9 are cross sectional views of the tool of FIG. 7 showing the plunger in a retracted and extended position respectively.
Figure 9:
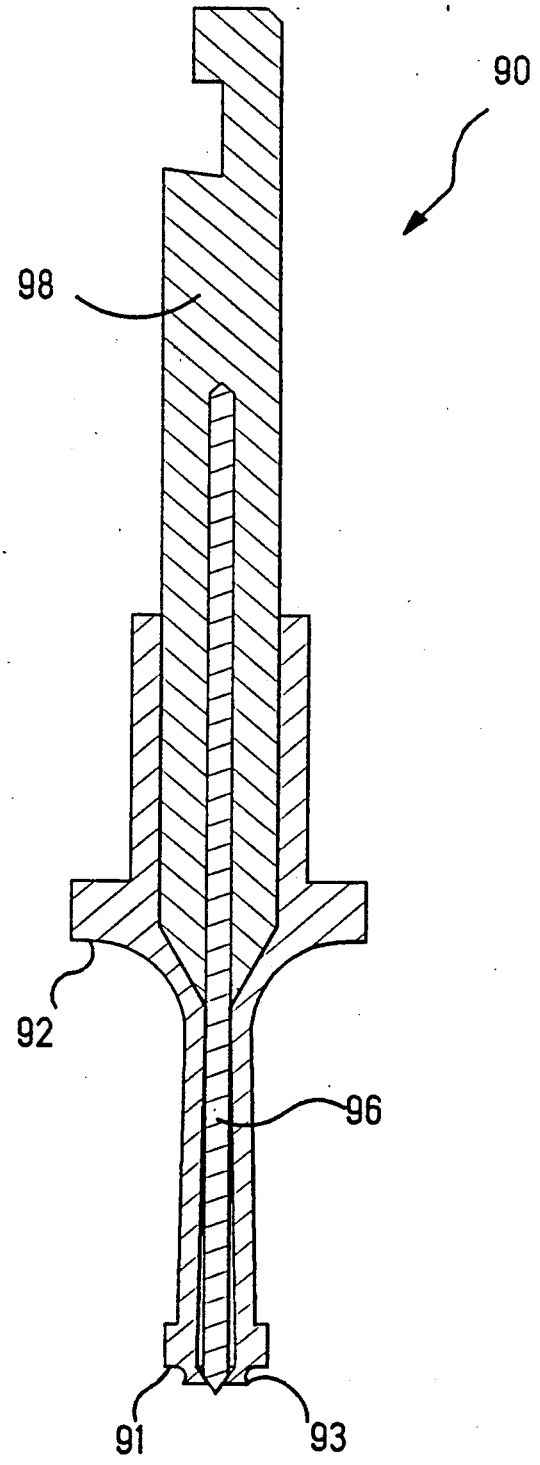

The operation of tool 90 is best understood by referring to FIGS. 7, 8 and 9. Tool 90 includes an outer collet portion 92 having a bore extending therethrough for receiving a punch member 96 secured to a handle 98. As best seen in FIGS. 8 and 9, collet 92 includes at least a pair of cantilever beams separated by slit 94 and coextending forwardly from a manually grippable section to a leading edge or work end of collet 92; the work end includes a leading curved portion 93 at the forward end of each cantilever beam dimensioned to be received within the flared aperture 56 of ground plate 50 and below the inner wall of the slot 20 of the corresponding side wall 18. After inserting the forward portion 93 of the collet within the opening until stop surface 91 abuts the surface of ground plate 52, the punch member 96 is moved forward to force the forward ends of the cantilever beams of the collet outwardly to urge outwardly the curved leading ends of forward portion 93 to expand the edges 58 of extruded metal outwardly to lock it onto the under surface of the housing wall 18. The punch includes a reduced diameter portion within the collet and having forwardly facing surfaces, which engage corresponding rearwardly facing surfaces of a reduced diameter bore portion of the collet, to define a forward stop for punch 96.

The punch member 96 is then retracted so that the tool 90 can be pulled from the opening. As can be appreciated, the amount of available space for inserting such a tool is limited owing to the presence of the terminal members in the housing. The locations of the flared apertures and corresponding wall slots are selected to provide the maximum space for operation of tool 90. The periodic interlocking of the ground plate to the elongate wall of the housing keeps the ground plate and housing wall securely together. If the housing wall should bow slightly, the ground plate will not separate from the housing wall. Since the two layers are attached securely together, the ground plate further provides support to minimize bowing of the wall.

It is thought that the means for securing the ground plate to an electrical connector in accordance with the present invention and many of its attendant advantages will be understood from the foregoing description. It will be apparent that various changes may be made in the form, construction and arrangement of the parts thereof without departing from the spirit or scope of the invention or sacrificing all of its material advantages.

We claim:

1. An improved means for securing an externally mounted ground plate to an electrical connector, said ground plate being exposed at least along a mating face of the connector, the connector including a housing having opposed elongate sides and opposed ends defining said mating face, a plurality of electrical terminals disposed within said housing and exposed at said mating face for electrical connection to corresponding terminals of a mating connector, said mating face being adapted to be received within a complementary housing, said connector further including at least one ground plate secured along one of the elongate sides and having a leading edge thereof exposed at the mating face and adapted to be received within said complementary housing, the improved means comprising:

a pair of tabs extending from said at least one ground plate proximate the leading edge thereof and engagable with cooperating slots on said end walls of said housing, said pair of tabs including outwardly extending locking lances which cooperate with said end wall slots to lockingly secure said at least one ground plate to said housing end walls; and said grounding plate further includes at least one inwardly directed flared aperture proximate the leading edge thereof, said inwardly directed flared aperture being adapted to be received within a slot along the edge of a housing sidewall and secured thereto by spreading the leading edge of the flared aperture outwardly by means of an appropriately shaped tool, thereby securing the leading edge of the ground plate to said housing along said mating face, whereby when said ground plate is secured to said housing, said pair of locking tabs hold said plate securely to the end walls of the connector housing and said at least one secured flared aperture holds said plate to said sidewall thereby minimizing stubbing of the ground plate when the mating face is received in the complementary connector.

2. The improved means of claim 1 wherein said ground plate further includes means for positioning and aligning said ground plate on said housing side wall.

3. The improved means of claim 1 further including a second of said ground plates secured to said other elongate housing wall.

4. A method of securing an externally mounted ground plate to an electrical connector including the steps of:

providing a ground plate adapted to be disposed along at least one selected wall of a connector housing at a mating face thereof, said ground plate having at least one inwardly directed flared aperture proximate the leading edge thereof, said inwardly directed flared aperture being adapted to be received within a corresponding slot along the edge of a housing sidewall forming a rolled edge along the leading edge of said ground plate, said rolled edge being adapted to received with a cooperating recess in said selected housing wall;

providing a recess in at least one selected wall at the mating face of a connector housing, said recess extending substantially the entire length of the mating face and adapted to receive said leading rolled edge of said ground plate;

forming a pair of tabs to extend from said at least one ground plate member proximate the leading edge thereof and engagable with cooperating slots on end walls of said housing, said pair of tabs including outwardly extending locking lances which cooperate with said end wall slots to lockingly secure said at least one ground plate to said housing end walls; and securing said ground plate to said selected housing wall by lockingly engaging said ground plate tabs in said housing slots and by spreading the leading edge of the flared aperture outwardly by means of an appropriately shaped tool, thereby securing the leading edge of the ground plate to said housing along said mating face, whereby the overall dimensions of the mating face not being substantially increased thereby.

* * * * *